US009222759B2

(12) United States Patent
White et al.

(10) Patent No.: US 9,222,759 B2
(45) **Date of Patent: *Dec. 29, 2015**

(54) BARRIER

(71) Applicant: Defenshield, Inc., East Syracuse, NY (US)

(72) Inventors: William Collins White, Cicero, NY (US); Jordan William Settle, Altoona, PA (US)

(73) Assignee: DEFENSHIELD, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/091,391

(22) Filed: Nov. 27, 2013

(65) Prior Publication Data

US 2014/0216239 A1 Aug. 7, 2014

Related U.S. Application Data

(63) Continuation-in-part of application No. 13/475,001, filed on May 18, 2012, now Pat. No. 8,726,780.

(60) Provisional application No. 61/487,496, filed on May 18, 2011.

(51) Int. Cl.

| | |
|---|---|
| ***F41H 5/24*** | (2006.01) |
| ***E04H 9/04*** | (2006.01) |
| ***F41H 5/08*** | (2006.01) |

(52) U.S. Cl.

CPC .. *F41H 5/24* (2013.01); *E04H 9/04* (2013.01); *F41H 5/08* (2013.01)

(58) Field of Classification Search

CPC ..... F41H 5/08; F41H 5/24; E04H 9/04

USPC ..... 89/36.04, 36.07, 36.08, 36.09, 36.14; 52/79.9, 169.6, 171.1, 478, 519, 531, 52/579; 109/78, 80, 85; D25/58

See application file for complete search history.

(56) References Cited

U.S. PATENT DOCUMENTS

| | | | | |
|---|---|---|---|---|
| 4,001,987 | A | 1/1977 | Coulthard | |
| 4,664,967 | A * | 5/1987 | Tasdemiroglu | 428/220 |
| 6,187,451 | B1 * | 2/2001 | Boos | 428/598 |
| 7,490,539 | B2 | 2/2009 | Ma | |
| D672,474 | S | 12/2012 | White et al. | |
| 8,726,780 | B2 * | 5/2014 | White et al. | 89/36.04 |
| 2005/0235819 | A1 | 10/2005 | Long | |
| 2007/0012168 | A1 | 1/2007 | Weatherwax | |
| 2007/0180982 | A1 | 8/2007 | Dagher et al. | |

(Continued)

*Primary Examiner* — Bret Hayes

(74) *Attorney, Agent, or Firm* — David L. Nocilly; George R. McGuire; Bond Schoeneck & King, PLLC

(57) ABSTRACT

A barrier formed from a plurality of identical modular units that have an essentially planar front panel and triangular shaped top and bottom plates extending rearward from the front panel. A plate is removably attached to the front panel. Adjacent units are interconnected to one another at their terminal vertices by a square tubular member. A square shaped opening is formed approximately centrally through each of the triangular shaped plates. In addition, elongated linkages may be provided at about the midpoint of each side edge for purposes of interconnecting units that are positioned adjacent to another unit so as to assist in the formation of the overall barrier. The linkages provide pivotal movement between adjacent barriers through a range of angles from about 90 degrees (to provide a corner arrangement) to 180 degrees (to provide a straight wall arrangement).

17 Claims, 15 Drawing Sheets

(56) References Cited

U.S. PATENT DOCUMENTS

| | | | |
|---|---|---|---|
| 2009/0282749 | A1 | 11/2009 | Warminsky |
| 2010/0043629 | A1 | 2/2010 | Carberry et al. |
| 2010/0089229 | A1 | 4/2010 | Ackerman et al. |
| 2011/0023759 | A1 | 2/2011 | Waller |
| 2011/0232543 | A1 | 9/2011 | Burroughs et al. |
| 2012/0168702 | A1 | 7/2012 | Fromm |

* cited by examiner

BARRIER

CROSS-REFERENCE TO RELATED APPLICATIONS

The present application is a continuation-in-part to U.S. patent application Ser. No. 13/475,001, filed on May 18, 2012, which claimed priority to U.S. Provisional Application No. 61/487,496 filed on May 18, 2011.

BACKGROUND OF THE INVENTION

1. Field of the Invention

The present invention relates generally to barriers, and more specifically to barriers comprising modular units of ballistic proof material.

2. Description of the Related Art

In military and para-military operations, there is often a need for barriers to be erected behind which personnel can position themselves for protection from ballistics, explosives, or other harmful projectiles. Historically, soldiers would dig fox holes or trenches, or utilize natural bunkers as protection against enemy fire. In certain geographic regions, natural formations may not exist, and it may not be practicable or suitable to utilize trenches or fox holes for adequate protection.

BRIEF SUMMARY OF THE INVENTION

It is therefore a principal object of the present invention to provide a barrier that may be built using modular units, each of which is man-portable.

It is another object of the invention to provide a barrier that may be formed in a variety of orientations.

Other objects and advantages of the present invention will in part be obvious and in part appear hereinafter.

In accordance with the foregoing objects and advantages, the present invention provides a barrier comprising a plurality of modular units, each of which is identical to the others. Each unit is composed of a ballistic proof material and comprises an essentially planar front panel and triangular shaped top and bottom plates extending rearward from the front panel and interconnected to one another at their terminal vertices by a square tubular member. A square shaped opening is formed approximately centrally through each of the triangular shaped plates. In addition, elongated linkages are provided at about the midpoint of each side edge for purposes of interconnecting units that are positioned adjacent to another unit so as to assist in the formation of the overall barrier. The linkages provide pivotal movement between adjacent barriers through a range of angles of essentially 90 degrees (which would provide for a square relationship between adjacent panels) to 180 degrees (which would provide for a straight wall type panel arrangement).

In addition to modular units that simply comprise front panels of ballistic proof material, additional modular units of the same basic construction are provided, but with windows (also composed of ballistic proof material), or movable covers for an aperture, also composed of ballistic proof material. The windows may be utilized when having a direct line of sight through the barrier is desired, and a unit with the movable cover for an aperture is utilized for providing access for a gun barrel or other weapon when desired.

Due to the symmetric and modular nature of the individual units, they may be assembled in any variety of shapes, including a planar barrier, a circular housing barrier, a curved barrier, or any other shape desired. In addition, each unit is sized (overall dimensions and weight) to make it man-portable according to military standards. The present invention may be used to replace sandbag bunkers, earth filled barriers, brick and mortar guard houses or checkpoints.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
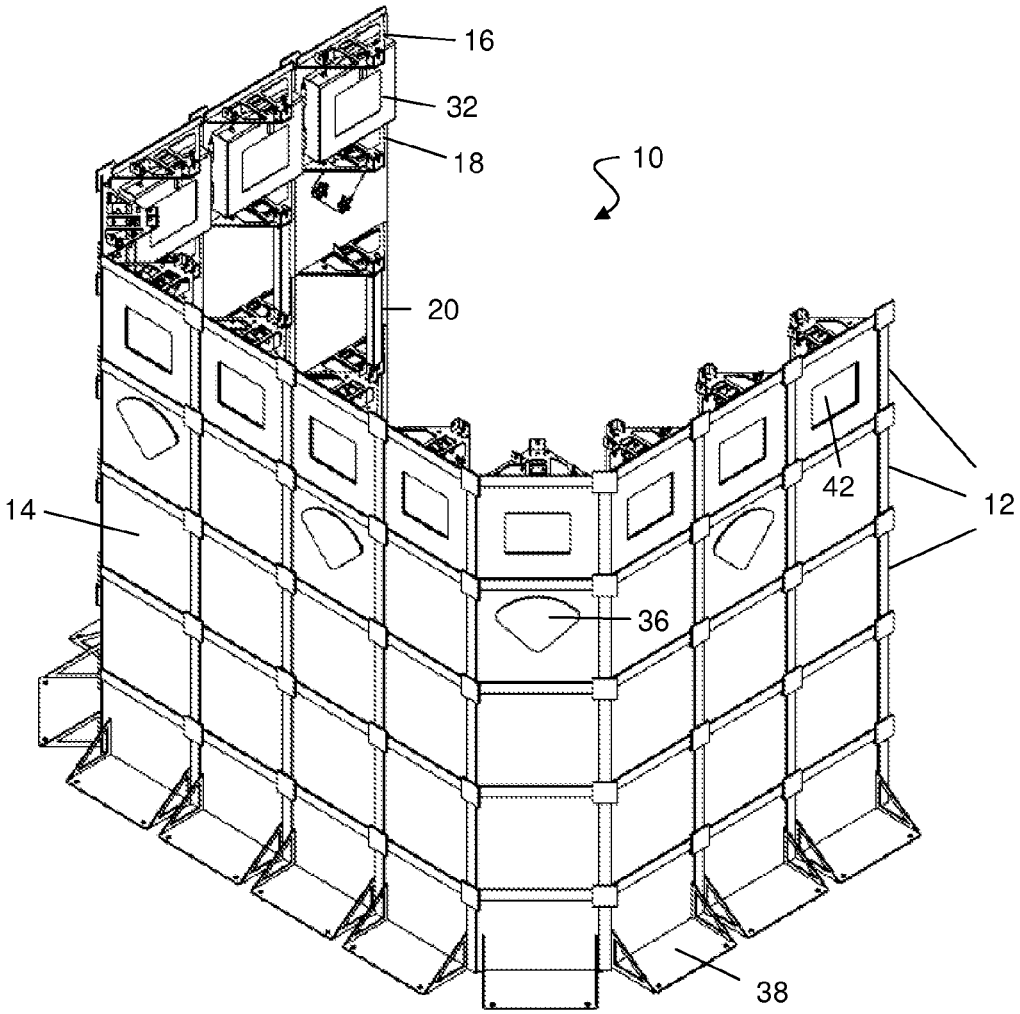
FIG. 1 is a front perspective view of a barrier composed of individual modular units in accordance with the present invention.
Figure 2:
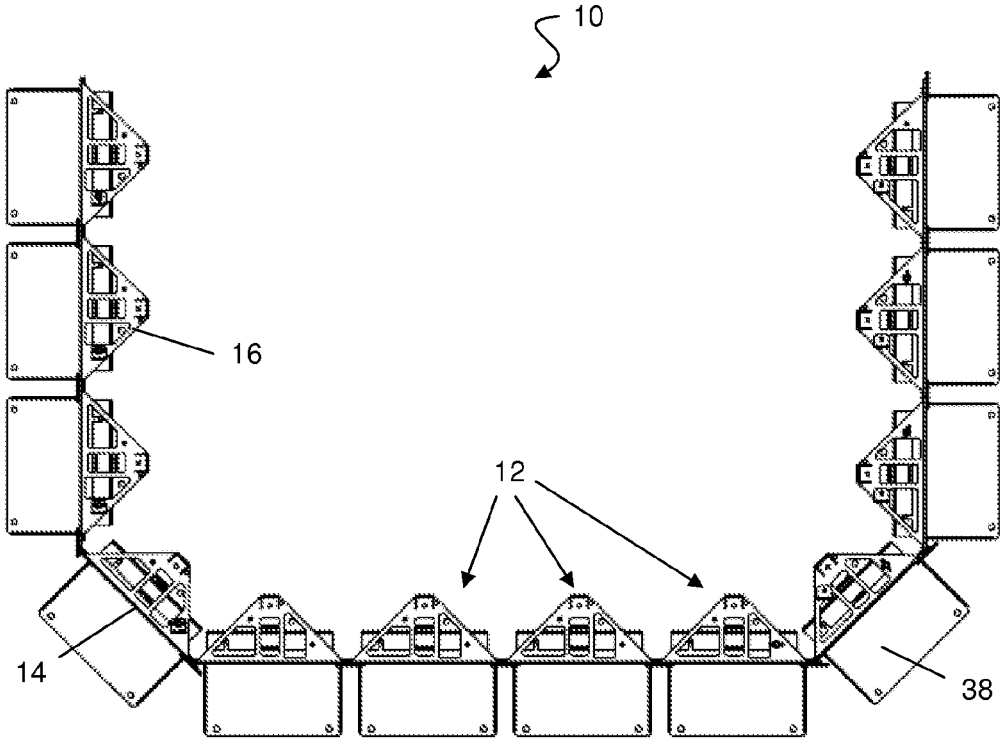
FIG. 2 is a top plan view thereof.

Referring now to the drawings, wherein like reference numerals refer to like parts throughout, there is seen in FIG. 1 a barrier, designated generally by reference numeral 10, comprising a plurality of individual modular units 12 interconnected to one another to form the barrier. Each unit 12 is composed of a ballistic proof material and is sized in dimension and weight to be man-portable according to military standards. It is a feature of the present invention that a battalion, squadron, or other grouping of personnel, each of whom can carry one unit 12, can assemble barrier quickly and in any shape desired (i.e., form barrier 10 in an essentially planar wall formation, in a circular fashion, in a curved formation, etc.). Referring to FIG. 2, units 12 may be interconnected to each other and capable of pivotal movement through a range of angles from about 90 degrees (to provide a corner arrangement) to 180 degrees (to provide a straight wall arrangement).

Figure 3:
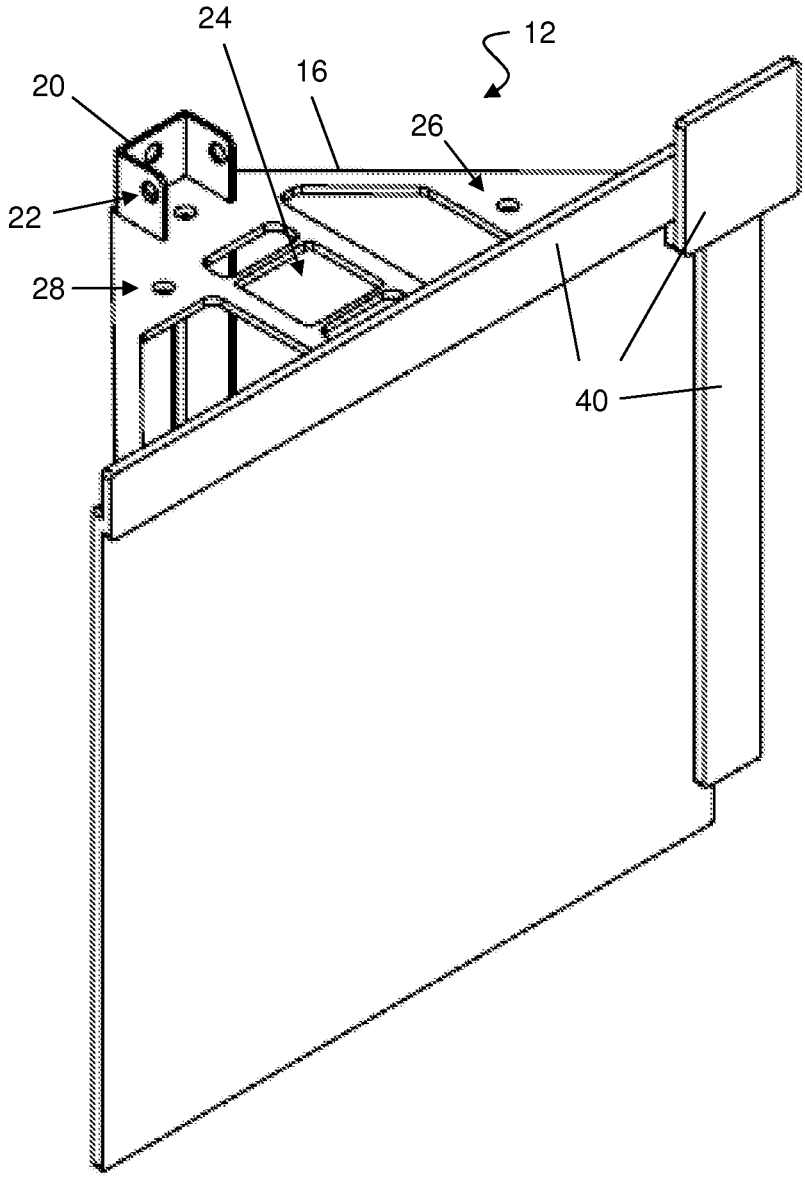
FIG. 3 is front perspective view of an individual modular unit in accordance with the present invention.
Figure 4:
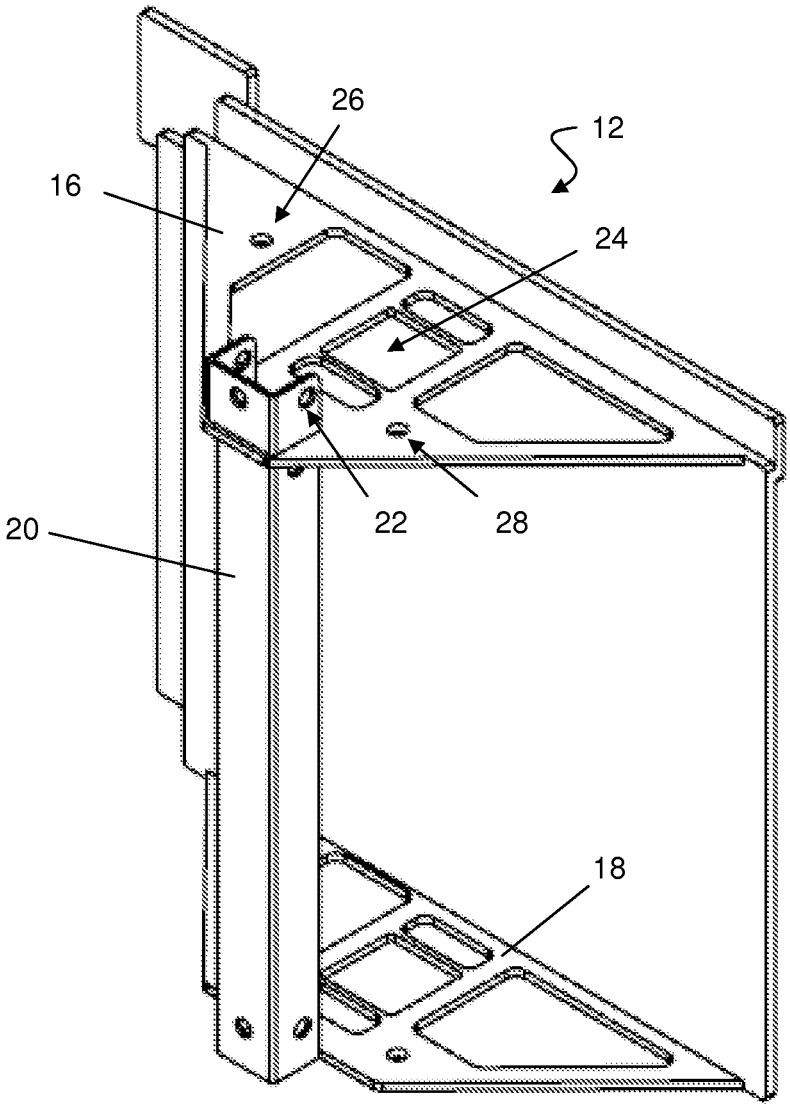
FIG. 4 is a rearward perspective of an individual modular unit in accordance with the present invention.

Referring to FIGS. 3 and 4, each modular unit 12 is composed of ballistic proof material and comprises an essentially planar front panel 14, top and bottom triangular shaped plates 16, 18 that each share a common edge with and extend rearward from the front panel 14 in perpendicular planes thereto (and in spaced, parallel planes to one another), and a tubular member 20 that extends between and interconnects top and bottom plates 16 and 18 at their respective, outwardly positioned vertices. Tubular member 20 is square in cross-section and includes a plurality of holes 22 formed through each surface, with each set of holes 22 on opposing sides being diametrically aligned with one another. In addition, the tubular nature of member 20 extends fully through plates 16 and 18, thereby providing a tubular passage therethrough which can be used for any desired purpose. It should be recognized by those of skill in art that member 20 does not have to be square tubular, or even fully tubular. Instead, member 20 need merely allow for interconnection to a vertically adjacent member 20. Preferably, the upper portion of member 20 and the lower portion of member 20 are dimensioned such that one will fit inside the other, with holes 22 in the upper portion of one unit 12 aligning with the lower portion of another unit 12 positioned thereon, thereby allowing units 12 to be interconnected to each other and held together via any conventional fastener, such as a bolt or pin, inserted through the aligned holes 22 of stacked units 12. Alternatively, member 20 may be formed from separate upper and lower sections for interconnecting to vertically adjacent units 12, such as that seen in FIGS. 5-8 and described below, when panel 14 includes features whose use would be inhibited if member 20 extended entirely from top plate 16 to bottom plate 18.

Referring to FIGS. 3 and 4, plates 16 and 18 each include an essentially centrally located opening 24 formed therethrough that can be used for any desired purpose, such as to hold elongated items. In addition, each plate 16 and 18 includes a first opening 26 formed adjacent one rearward extending edge and adjacent to front panel 12, and a second opening 28 formed adjacent the opposite rearward extending edge and adjacent to tubular member 20. As further seen in FIGS. 3 and 4, one of the upper or lower edges of front panel 14 and one of the side edges of front panel 14 may include one or more overlapping plates 40 that are spaced apart from panel 14 by an integrally formed shoulder 42 so that plates 40 that extends in a plane parallel to panel 14 for the purposes of overlapping the front panel 14 of an adjacent unit 14 when units 12 are assembled into barrier 10.

Figure 5:
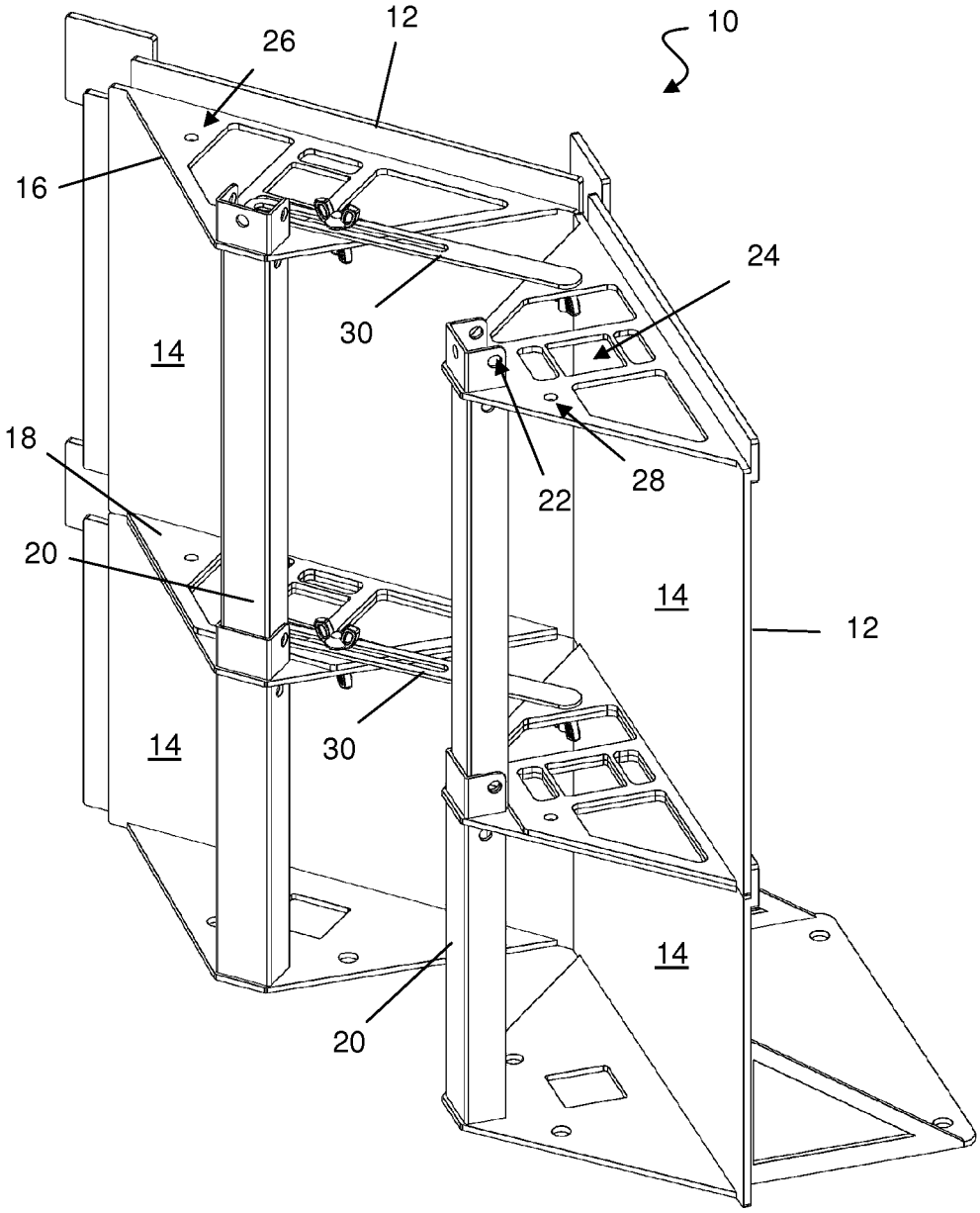
FIG. 5 is a rear perspective view of a portion of a barrier composed of individual modular units in accordance with the present invention.

Referring to FIG. 5, when assembling barrier 10, adjacent units may optionally be interconnected by linkages 30 that are fastened between opening 26 on one unit 12 and opening 28 on the laterally adjacent unit 12. Linkages 30 permit pivotal movement of one unit 12 relative to its laterally adjacent unit 12, thereby permitting barrier 10 to be formed in any desired shape, including a planar wall structure, a curved barrier structure, or even a fully enclosed barrier (where all personnel would be fully enclosed on all sides by the barrier).

Figure 6:
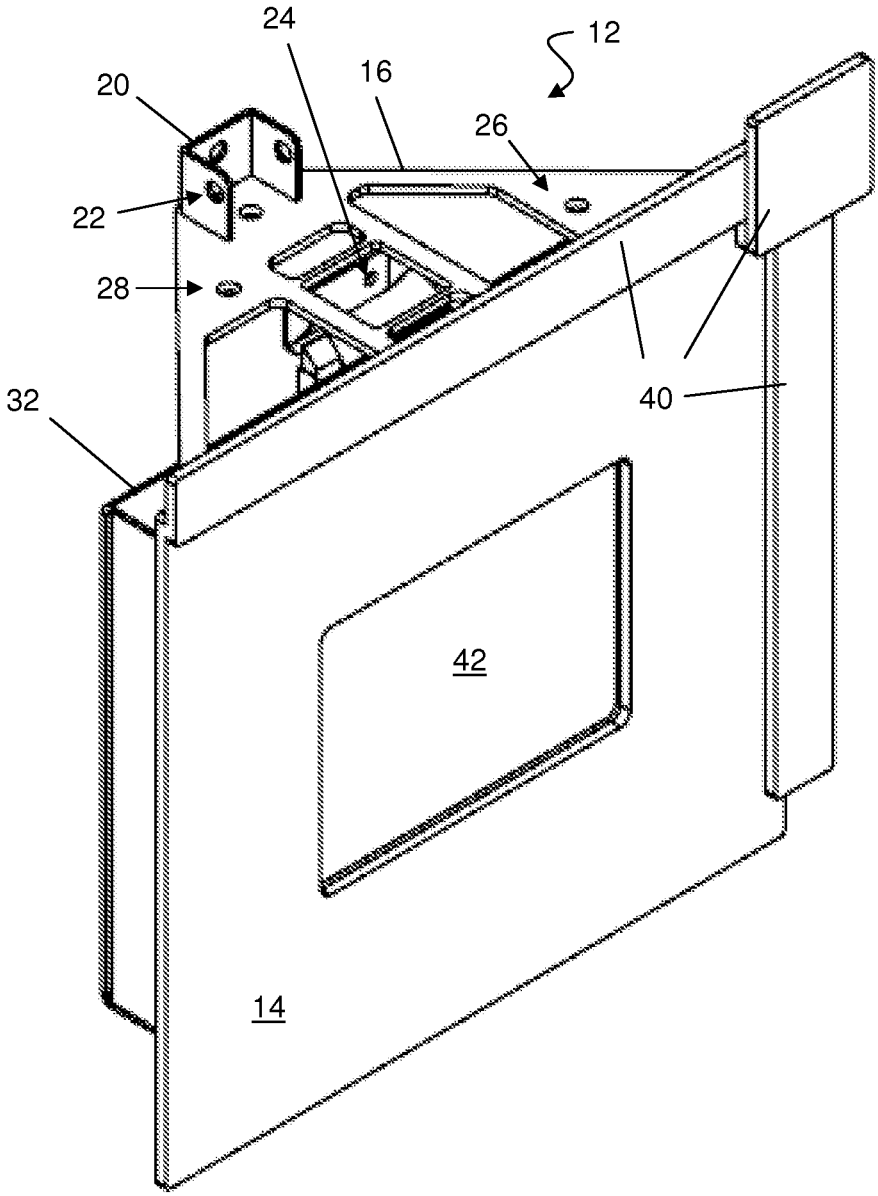
FIG. 6 is front perspective view of a first alternative embodiment of an individual modular unit in accordance with the present invention.
Figure 7:
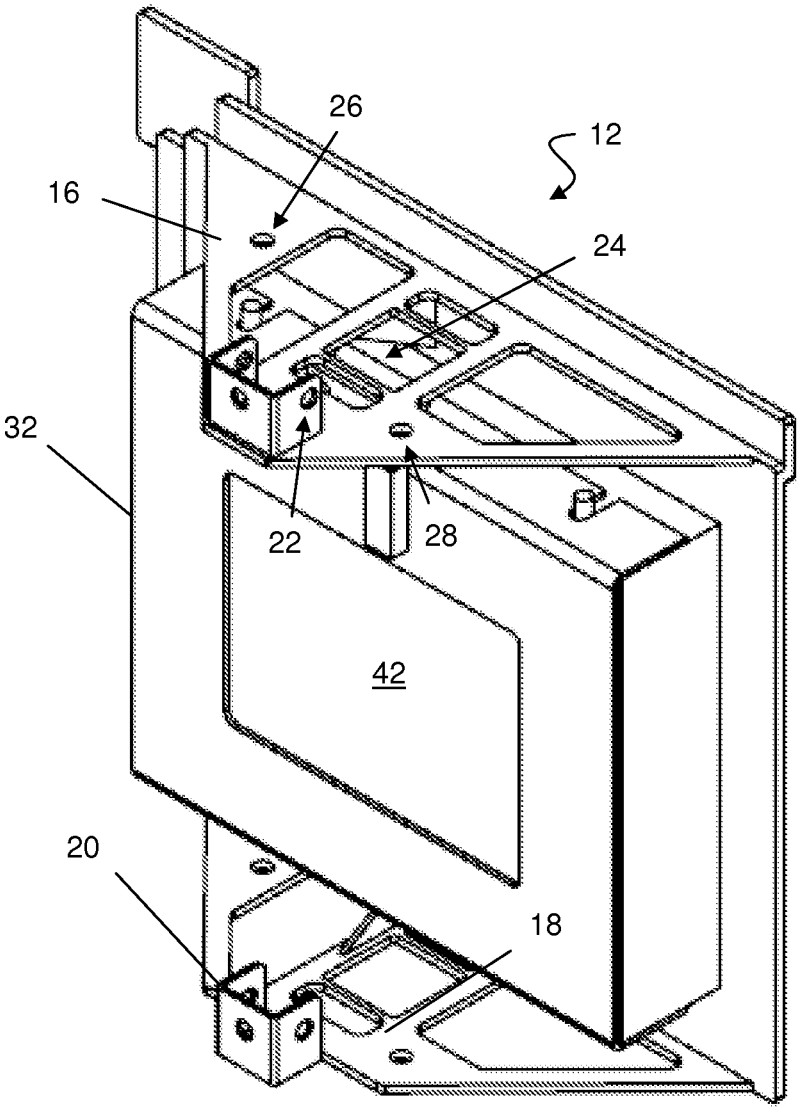
FIG. 7 is a rearward perspective of a first alternative embodiment of an individual modular unit in accordance with the present invention
Figure 8:
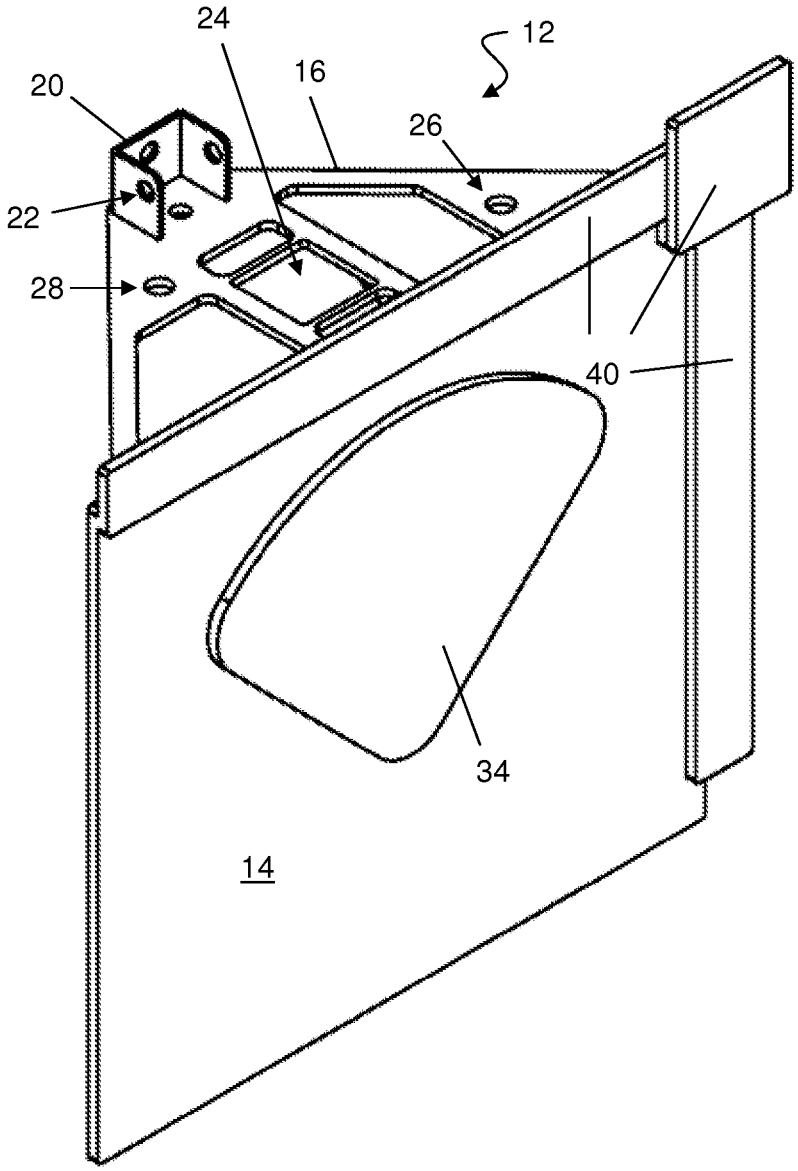
FIG. 8 is front perspective view of a second alternative embodiment of an individual modular unit in accordance with the present invention.
Figure 9:
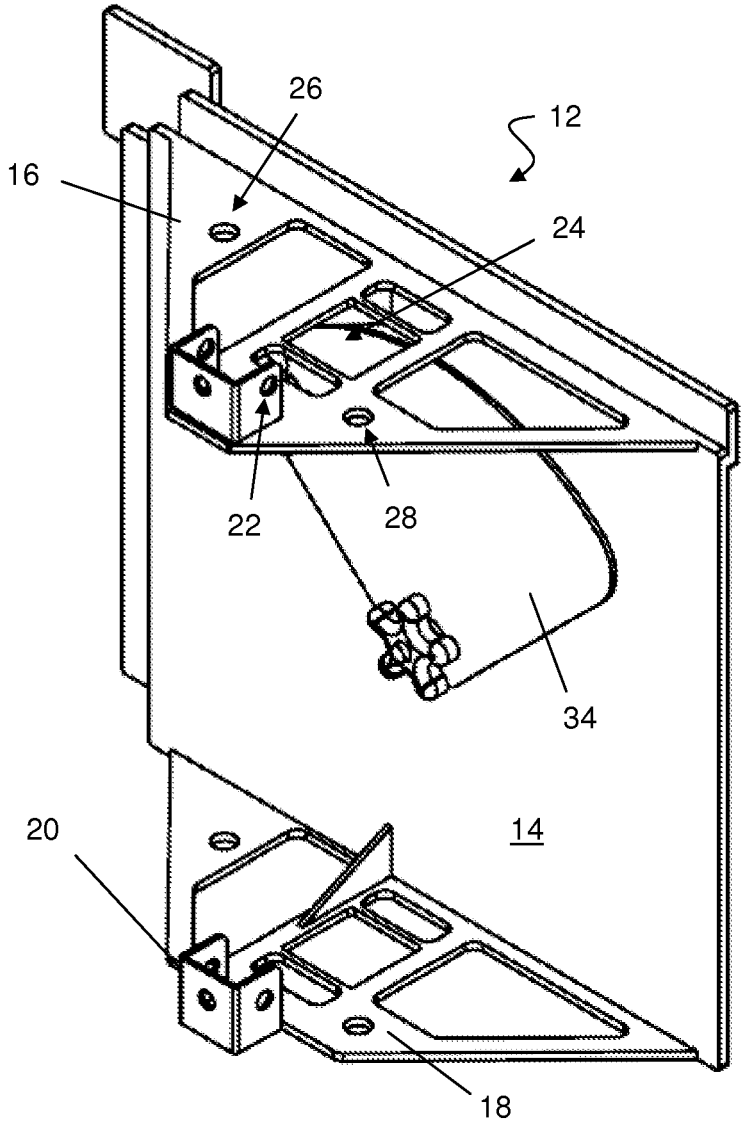
FIG. 9 is a rearward perspective of a second alternative embodiment of an individual modular unit in accordance with the present invention.
Figure 10:
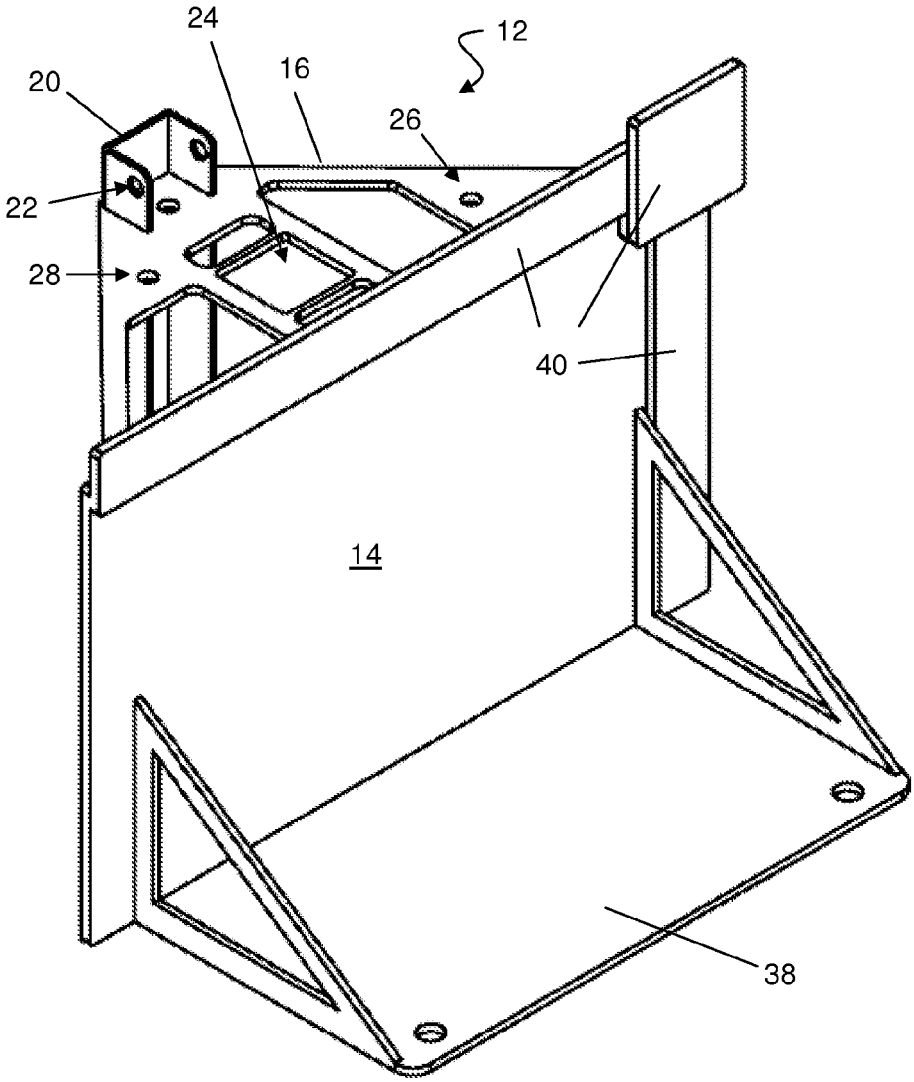
FIG. 10 is front perspective view of a third alternative embodiment of an individual modular unit in accordance with the present invention.
Figure 11:
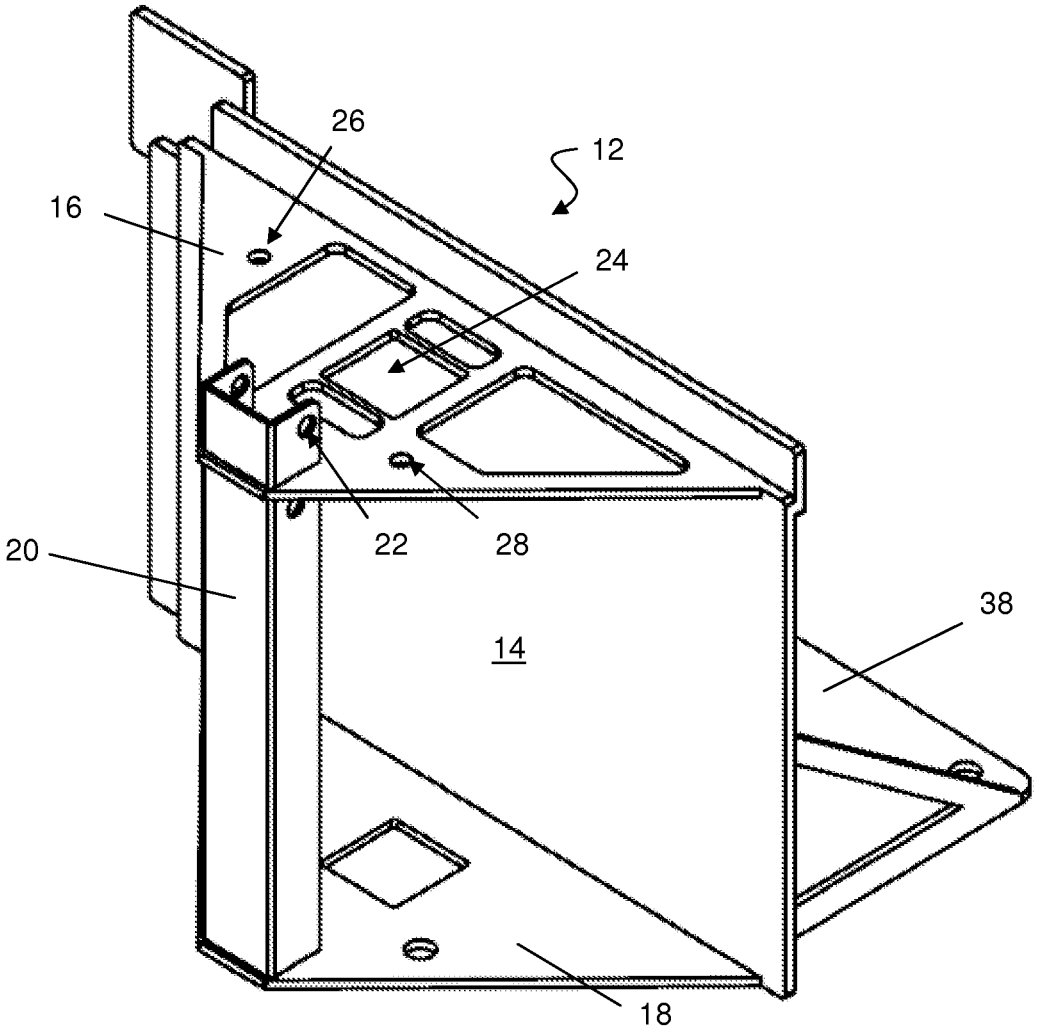
FIG. 11 is a rearward perspective of a fourth alternative embodiment of an individual modular unit in accordance with the present invention.

In addition to front panels 12 comprising a solid panel of ballistic proof/resistant material, alternative embodiments of the present invention may provide panels 12 that serve additional purposes. For example, as seen in FIGS. 6 and 7, panels 12 may include a pivotal window frame 32 containing a transparent portion 42 that is preferably composed of ballistic proof/resistant material for viewing or for permitting objects to be based through barrier 10. Alternatively, as seen in FIGS. 8 and 9, panels 12 may include a movable cover 34 composed of a ballistic proof/resistant material for selectively exposing or covering a gun port 36 through which a weapon can be pointed and discharged. In yet a further embodiment of the invention, as seen in FIGS. 10 and 11, some units 12 may include a platform 38 attached to the lower edge of panel 14 so that units 12 with platform 38 may be used as a more stable base for barrier 10. In yet another alternate embodiment of the present invention, panels 14 may includes slightly sloped front faces at both the top and bottom edges that provide a solid surface when barrier 10 is formed as a straight wall. It should be recognized by those of skill in the art that panels 14 may be provided with any number of features that are desirable or advantageous in a ballistic barrier. Thus configured, the present invention may be used to replace sandbag bunkers, earth filled barriers, brick and mortar guard houses or checkpoints.

Referring to FIGS. 12 through 15, another embodiment of the invention comprises a modular unit 50 similar to the earlier embodiments; however, ballistic front panel 14 has been replaced with a mounting panel 52 to which a removable ballistic plate 54 may be attached. For example, plate 54 may include one or more threaded posts 56 that are passed through corresponding holes 58 formed through mounting panel 52. Wing nuts 60 may then be used to swiftly mount plate 54 onto mounting panel 52. Other conventional forms of securing plate 54 to mounting panel 52 may be used in lieu of posts 56 and wing nuts 60, such as rivets, bolts, clips, and the like. In this embodiment of the present invention, ballistic plate 54 may be easily replaced in the event of damage without having to dissemble a wall of units 50 to replace one with the damaged front.

Figure 12:
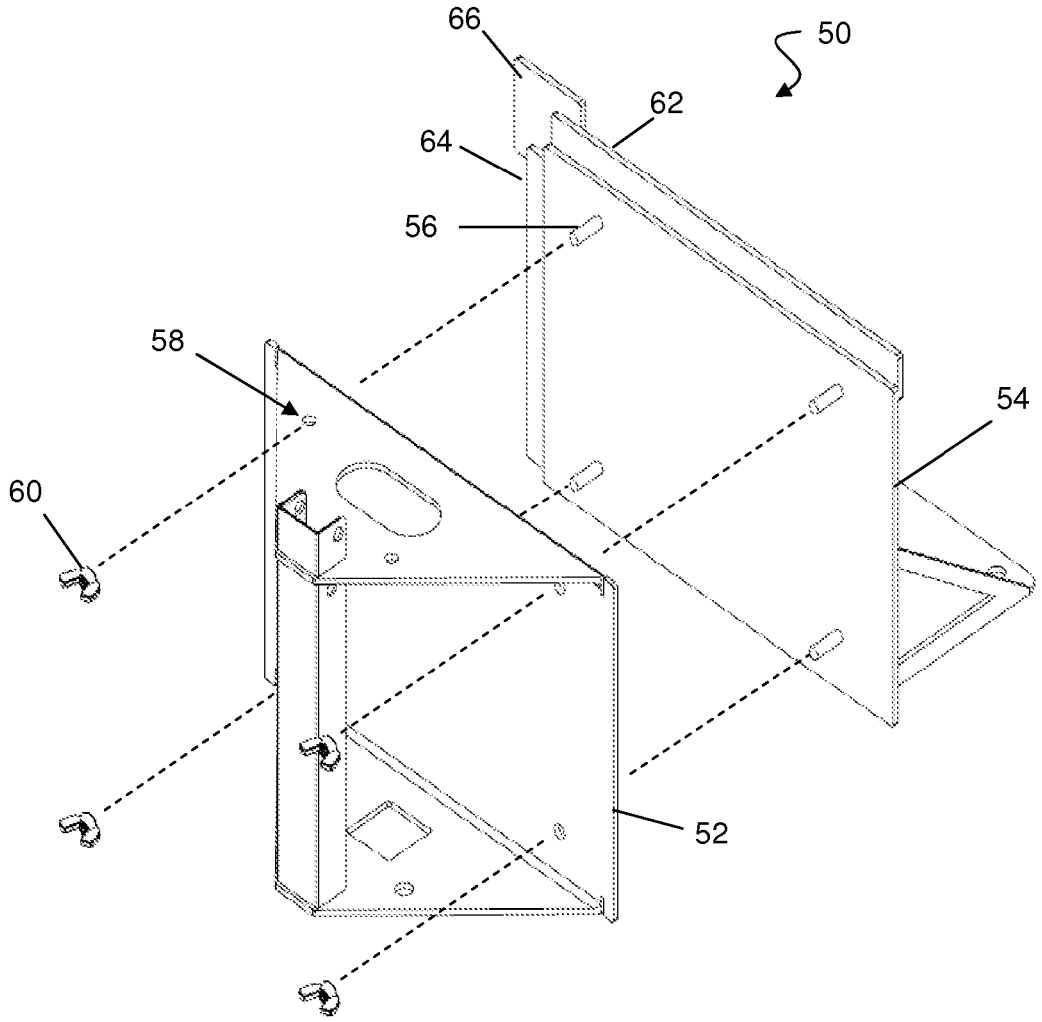
FIG. 12 is rear exploded perspective view of an alternative embodiment of an individual modular unit having a removable ballistic plate in accordance with the present invention.
Figure 13:
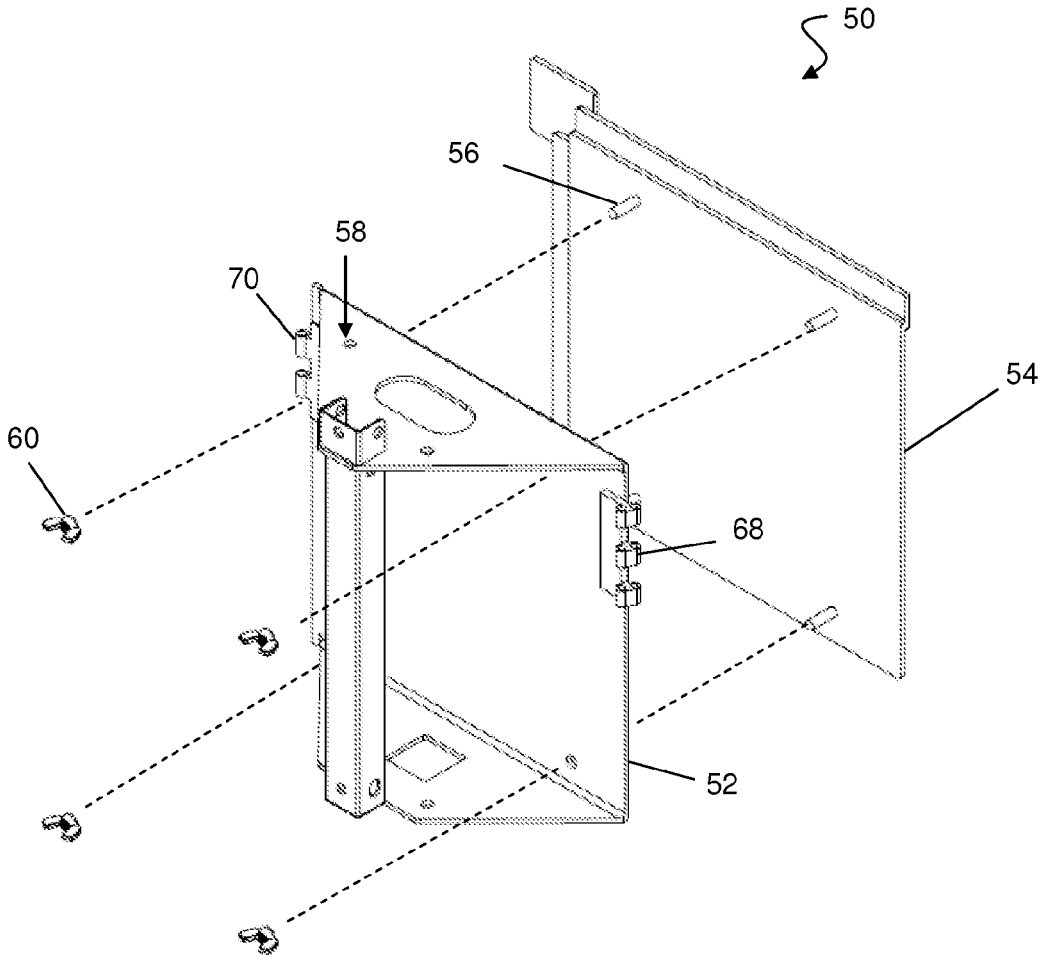
FIG. 13 is a rear exploded perspective of an alternative embodiment of an individual modular unit having a removable ballistic plate in accordance with the present invention.
Figure 14:
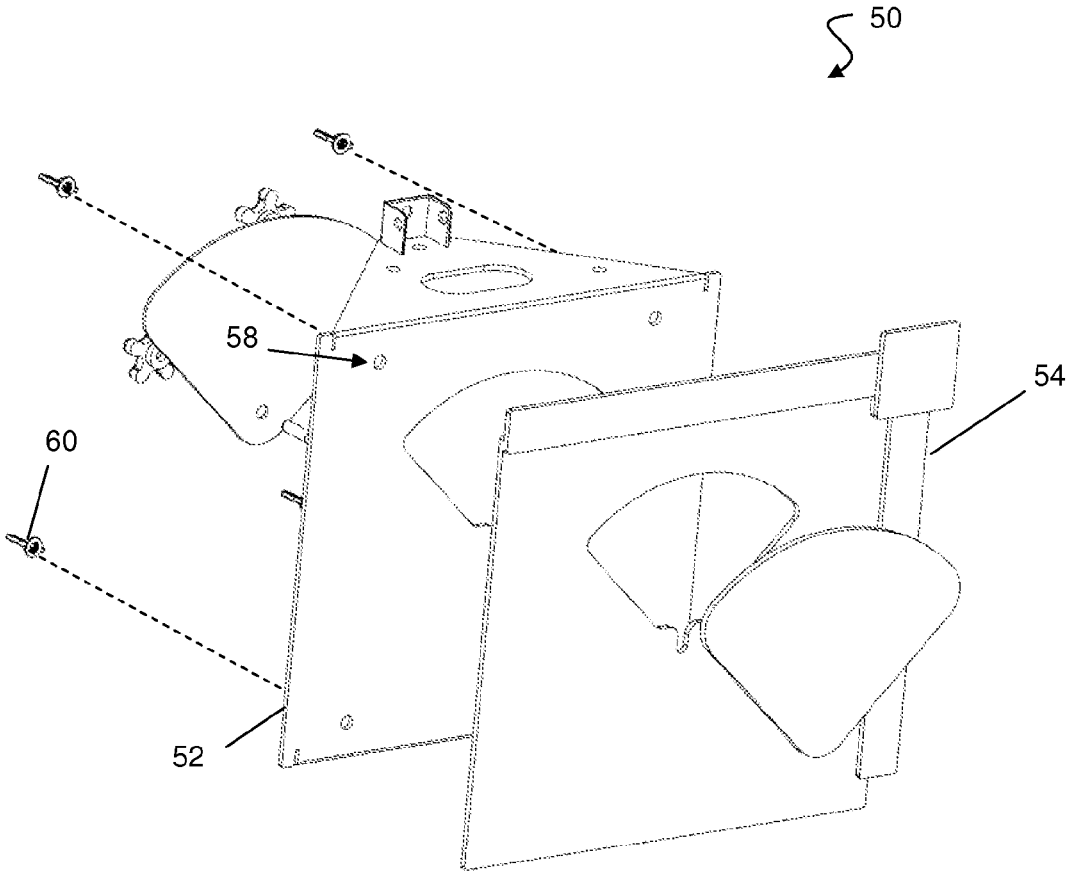
FIG. 14 is a front exploded perspective of an alternative embodiment of an individual modular unit having a removable ballistic plate in accordance with the present invention.
Figure 15:
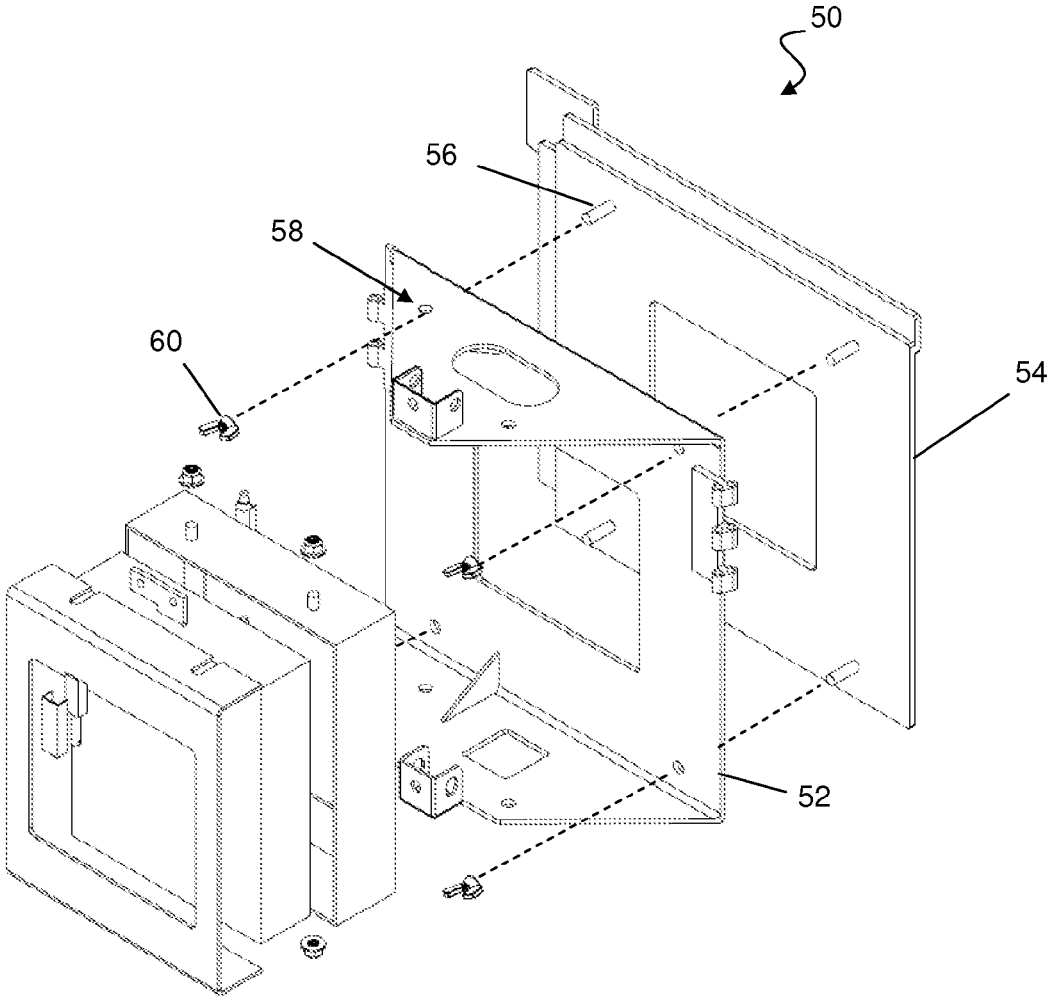
FIG. 15 is a rear exploded perspective of an alternative embodiment of an individual modular unit having a removable ballistic plate in accordance with the present invention.

As seen in FIG. 12, plate 54, rather than panel 52, includes a first spaced apart portion 62 that extends beyond one of outer edges of panel 52, a second spaced apart portion 64 that extends beyond another edge of panel 52, and a third spaced apart portion 66 positioned to extend beyond one corner. Portions 62, 64, and 66 are arranged to overlap with adjacently positioned plates 54 to cover any seams between adjacent units 50 and thus may be provided in other configurations that produce the same coverage. As seen in FIG. 13, panel 52 may further include a half hinge 68 mounted on one side and a corresponding half hinge 70 mounted on the other side, thereby allowing adjacent panels 52 to be connected together by mating the two half hinges 68 and 70 and inserting a hinge pin or other post therethrough.

What is claimed is:

1. A modular ballistic barrier, comprising:

a front panel defining a top edge, a bottom edge, and two side edges;

opposing top and bottom panels extending perpendicularly from said top and bottom edges of said front panel; and a first tubular member extending from said top panel;

a second tubular member extending from said bottom panel; and a plate removably attached to said front panel that includes a central portion abutting and extending coextensively with said front panel and a first overlapping portion that is spaced apart from said central portion and that extends beyond said panel.

2. The barrier of claim 1, further comprising a second overlapping portion that is spaced apart from said central portion and that extends beyond said panel.

3. The barrier of claim 2, further comprising a third overlapping portion that is spaced apart from said central portion and that extends beyond said panel.

4. The barrier of claim 3, wherein said first tubular member and said second tubular member each include at least one hole formed transversely therethrough.

5. The barrier of claim 4, wherein said first tubular member and said second tubular member are dimensioned such that said first tubular member and said second tubular member telescopically engage when brought together in longitudinal axial alignment.

6. The barrier of claim 5, wherein said at least one hole formed transversely through said first tubular member would align with said at least one hole of said second tubular member if said first tubular member and said second tubular member were telescopically engaged with each other.

7. The barrier of claim 6, further comprising a linkage having a first end connected to said top panel and a second end adapted for slidingly engaging a top panel of a second, adjacently positioned modular ballistic barrier.

8. A modular ballistic barrier system, comprising:

a plurality of modular units positioned horizontally and vertically adjacent to each other, wherein each unit comprises a front panel defining a top edge, a bottom edge, and two side edges, opposing top and bottom panels extending perpendicularly from said top and bottom edges of said front panel, a first tubular member extending from said top panel, a second tubular member extending from said bottom panel, and a plate removably attached to said front panel that includes a central portion abutting and extending coextensively with said front panel and a first overlapping portion that is spaced apart from said central portion and that extends beyond said panel; wherein said first tubular member of at least one of said modular units is telescopically engaged with said second tubular member of at least another vertically adjacent modular unit.

9. The system of claim 8, wherein at least one said plurality of modular units includes a window frame pivotally mounted to said front panel that includes a transparent window positioned therein.

10. The system of claim 8, wherein at least one modular unit includes a pivotally mounted cover for selectively covering or expositing a port formed through the front panel of said at least one modular unit.

11. The system of claim 8, wherein at least one modular unit includes a platform extending perpendicularly from the bottom edge of the front panel of said at least one modular unit.

12. The barrier of claim 8, wherein each of said plurality of modular units further comprises a second overlapping portion spaced apart from said first panel and extending from one of said side edges of said plate to overlap said plate of said horizontally adjacent modular units.

13. The barrier of claim 12, wherein each of said plurality of modular units further comprises a third overlapping portion spaced apart from said first panel and extending from one of said side edges of said plate to overlap said plate of said horizontally adjacent modular units.

14. A method of forming a protective barrier, comprising the steps of:

providing a first modular unit having a front panel defining a top edge, a bottom edge, and two side edges, opposing top and bottom panels extending from said top and bottom edges of said front panel, a first tubular member extending from said top panel, a second tubular member extending from said bottom panel;

providing a second modular unit having a front panel defining a top edge, a bottom edge, and two side edges, opposing top and bottom panels extending from said top and bottom edges of said front panel, a first tubular member extending from said top panel, a second tubular member extending from said bottom panel;

positioning said second modular unit adjacently above said first modular unit so that said first tubular member of said first modular unit engaging with said second tubular member of said second modular unit;

securing said first and second module units to each other;

affixing a first plate to said front panel of said first modular unit, wherein said first plate includes a first central portion abutting and extending coextensively with said front panel and a first overlapping portion that is spaced apart from said central portion and that extends beyond said panel; and affixing a second plate to said front panel of said second modular unit, wherein said second plate includes a second central portion abutting and extending coextensively with said front panel and a second overlapping portion that is spaced apart from said central portion and that extends beyond said panel.

15. The method of claim 14, wherein the step of securing said first and second module units to each other comprises inserting a pin through said first tubular member of said first modular unit and said second tubular member of said second modular unit.

16. The method of claim 15, wherein the step of affixing a first plate to said front panel of said first modular unit comprises positioning said first plate so that a plurality of threaded shafts extend through a corresponding plurality of holes formed through said front panel.

17. The method of claim 16, wherein the step of affixing a first plate to said front panel of said first modular unit further comprises the step of threading a corresponding plurality of nuts onto said plurality of threaded shafts after said shafts extend through said corresponding plurality of holes formed through said front panel.

* * * * *